US010508785B2

(12) United States Patent
Miller et al.

(10) Patent No.: US 10,508,785 B2
(45) Date of Patent: Dec. 17, 2019

(54) LIGHT SYSTEM FOR FIREPLACE INCLUDING CHAOS CIRCUIT

(71) Applicant: HNI Technologies Inc., Muscatine, IA (US)

(72) Inventors: Charles Miller, Lake City, MN (US); David Lyons, Red Wing, MN (US); Suman Minnaganti, Austin, TX (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 16/021,631

(22) Filed: Jun. 28, 2018

(65) Prior Publication Data

US 2019/0003669 A1 Jan. 3, 2019

Related U.S. Application Data

(60) Provisional application No. 62/527,297, filed on Jun. 30, 2017.

(51) Int. Cl.

| | |
|---|---|
| ***F21S 10/04*** | (2006.01) |
| ***H05B 37/02*** | (2006.01) |
| ***H05B 33/08*** | (2006.01) |
| *F21Y 115/10* | (2016.01) |

(52) U.S. Cl.

CPC ..... *F21S 10/04* (2013.01); *F21S 10/043* (2013.01); *H05B 33/083* (2013.01); *H05B 33/0842* (2013.01); *H05B 33/0845* (2013.01); *H05B 37/029* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 5,924,784 | A | 7/1999 | Chliwnyj et al. | |
| 7,373,743 | B1 | 5/2008 | Hess | |
| 8,738,675 | B2 * | 5/2014 | Ergun | G06F 7/58 708/250 |
| 2002/0154677 | A1 | 10/2002 | Occhipinti et al. | |
| 2002/0168182 | A1 | 11/2002 | Martin et al. | |
| 2004/0165383 | A1 | 8/2004 | Hess et al. | |
| 2005/0097792 | A1 * | 5/2005 | Naden | F24C 7/004 40/428 |
| 2005/0134409 | A1 | 6/2005 | Gandhi | |
| 2006/0098428 | A1 | 5/2006 | Rosserot | |
| 2006/0101681 | A1 | 5/2006 | Hess et al. | |
| 2007/0107279 | A1 | 5/2007 | Wei et al. | |
| 2008/0004124 | A1 | 1/2008 | O Neill | |
| 2008/0013931 | A1 | 1/2008 | Bourne | |
| 2008/0091259 | A1 | 4/2008 | Heggestuen et al. | |
| 2008/0138050 | A1 | 6/2008 | Moreland et al. | |

(Continued)

FOREIGN PATENT DOCUMENTS

| | | |
|---|---|---|
| CN | 101295454 A | 10/2008 |
| CN | 201209898 Y | 3/2009 |

(Continued)

*Primary Examiner* — Dedei K Hammond

(74) *Attorney, Agent, or Firm* — Faegre Baker Daniels LLP

(57) ABSTRACT

A light system for a fireplace, including a plurality of lights, and a chaos circuit coupled to the plurality of lights. The chaos circuit is configured to provide signals to the plurality of lights to provide naturalistic flame lighting and naturalistic ember lighting.

32 Claims, 7 Drawing Sheets

(56) References Cited

U.S. PATENT DOCUMENTS

| | | | | |
|---|---|---|---|---|
| 2009/0126241 | A1 | 5/2009 | Asofsky | |
| 2013/0106481 | A1 | 5/2013 | Campos Canton et al. | |
| 2014/0373406 | A1 | 12/2014 | Flynn et al. | |
| 2019/0011099 | A1* | 1/2019 | Schnuckle ..... | F21S 10/04 |

FOREIGN PATENT DOCUMENTS

| | | | |
|---|---|---|---|
| CN | 103236918 | A | 8/2013 |
| CN | 104022864 | A | 9/2014 |
| CN | 203984744 | U | 12/2014 |
| CN | 104954115 | A | 9/2015 |
| CN | 106209345 | A | 12/2016 |
| GB | 2457485 | A | 8/2009 |
| WO | WO2010030924 | A2 | 3/2010 |

* cited by examiner

LIGHT SYSTEM FOR FIREPLACE INCLUDING CHAOS CIRCUIT

CROSS-REFERENCE TO RELATED APPLICATION

This application claims the benefit of Provisional Application No. 62/527,297, filed Jun. 30, 2017, which is herein incorporated by reference in its entirety.]

BACKGROUND

Fireplaces often serve as a focal point in a room and may be at the heart of a home. Fireplaces come in a variety of styles and types including wood burning fireplaces, gas burning fireplaces, ethanol burning fireplaces, and electric fireplaces. Gas burning fireplaces usually burn natural gas.

Typically, manufacturers try to make fireplaces, such as gas burning fireplaces, ethanol burning fireplaces, and electric fireplaces, look as realistic as possible, as if they are burning logs and have glowing embers in them. The more realistic the flames and embers appear, the more desirable the fireplace is to the end-user. Often, these fireplaces include log and ember arrangements that are illuminated by one or more lights. However, if the flame and ember movement is systematic or has a discernible pattern to it, the end-users may be dissatisfied with the fireplace. Manufacturers continually strive to improve the realism of the flames and the glowing embers.

SUMMARY

Some embodiments relate to a light system for a fireplace, including a plurality of lights, and a chaos circuit coupled to the plurality of lights. The chaos circuit is configured to provide signals to the plurality of lights to provide naturalistic flame lighting and naturalistic ember lighting.

In some embodiments, the plurality of lights includes at least one backlight that receives at least one of the signals and the at least one backlight flickers based on the at least one of the signals to provide the naturalistic flame lighting.

In some embodiments, the plurality of lights includes at least one ember light that receives at least one of the signals and the at least one ember light irregularly glows based on the at least one of the signals to provide the naturalistic ember lighting.

Some embodiments relate to a light system for a fireplace, including lights, and a chaos circuit coupled to the lights. The chaos circuit is configured to provide drive signals that illuminate the lights to provide naturalistic lighting. The chaos circuit includes a plurality of microprocessors configured to generate random numbers, and an analog circuit that receives filtered signals based on the random numbers and provides the drive signals based on the filtered signals.

In some embodiments, the chaos circuit includes an oscillator configured to provide an oscillator output signal, and a plurality of analog comparators configured to receive the oscillator output signal and to receive the filtered results.

Some embodiments relate to a method of providing light in a fireplace. The method including generating signals using a chaos circuit, and providing the signals to a plurality of lights to provide naturalistic lighting.

In some embodiments, generating signals and providing the signals includes generating at least one backlight signal using the chaos circuit, and providing the at least one backlight signal to at least one backlight, such that the at least one backlight flickers in response to the at least one backlight signal to provide naturalistic flame lighting.

In some embodiments, generating signals and providing the signals includes generating at least one ember light signal using the chaos circuit, and providing the at least one ember light signal to at least one ember light, such that the at least one ember light irregularly glows in response to the at least one ember light signal to provide naturalistic ember lighting.

In some embodiments, generating signals and providing the signals includes generating random numbers via at least one microprocessor, providing filtered results based on the random numbers, receiving the filtered results at an analog circuit, and providing the signals from the analog circuit based on the filtered results.

In some embodiments, generating signals includes generating an oscillator output signal via an oscillator, and comparing the oscillator output signal and the filtered results via at least one comparator.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

The Figures are meant to be illustrative in nature and are not to be taken as exclusive or limiting in scope.

DETAILED DESCRIPTION

Figure 1A:
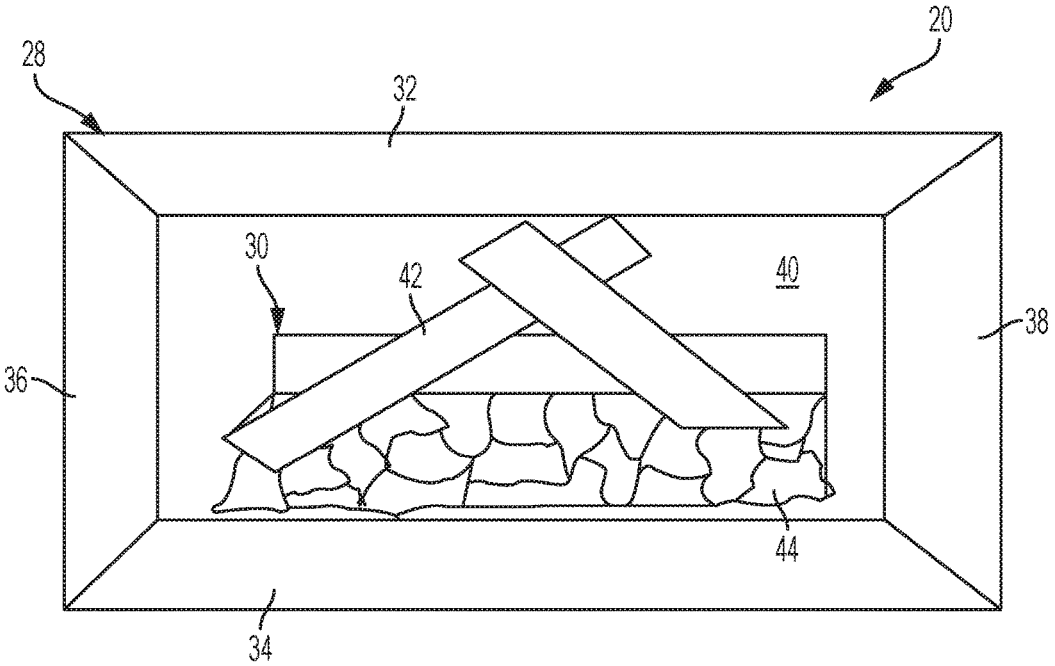
FIG. 1A is a diagram illustrating the fireplace, according to embodiments of the disclosure.
Figure 1B:
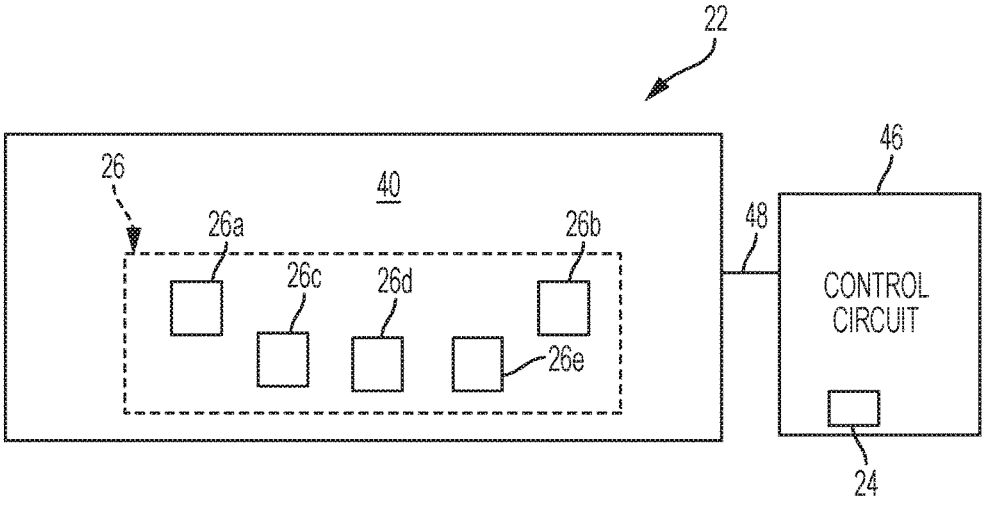
FIG. 1B is a diagram illustrating the light system, according to embodiments of the disclosure.

FIGS. 1A and 1B are diagrams illustrating a fireplace 20 that includes a light system 22 for the fireplace 20. The light system 22 includes a chaos circuit 24 that activates a plurality of lights 26 to provide naturalistic flame lighting and naturalistic ember lighting. In some embodiments, the fireplace 20 is a gas fireplace. In some embodiments, the fireplace 20 is an ethanol burning fireplace. In some embodiments, the fireplace 20 is an electric fireplace.

FIG. 1A is a diagram illustrating the fireplace 20, according to embodiments of the disclosure. The fireplace 20 includes a housing 28 and a log and ember arrangement 30. The housing 28 includes a top wall 32, a bottom wall 34, two side walls 36 and 38, and a back wall 40. The log and ember arrangement 30 includes logs 42 and artificial embers 44 situated in the housing 28. In some embodiments, the logs 42 are non-transparent or solid and the artificial embers 44 are at least partially translucent. In some embodiments, the log and ember arrangement 30 is secured to the housing 28, such as to the bottom wall 34 and/or to the back wall 40.

FIG. 1B is a diagram illustrating the light system 22, according to embodiments of the disclosure. The light system 22 is situated in front of the back wall 40 and behind the log and ember arrangement 30. The light system 22 includes the plurality of lights 26 activated by a control circuit 46 that is electrically coupled to the plurality of lights 26 via conductive path 48. The control circuit 46 includes the chaos circuit 24, which is electrically coupled to the plurality of lights 26 via the conductive path 48. The chaos circuit 24 activates the plurality of lights 26 to provide the naturalistic flame lighting and the naturalistic ember lighting.

The plurality of lights 26 includes two backlights 26*a* and 26*b* and three ember lights 26*c*, 26*d*, and 26*e*. In some embodiments, each of the plurality of lights 26 is a light emitting diode (LED). In some embodiments, each of the plurality of lights 26 is secured in a tub, such as a reflective metal tub. In some embodiments, each of the plurality of lights 26 is mounted on a printed circuit board. In some embodiments, each of the plurality of lights 26 is mounted on a printed circuit board that is mounted or fastened to an aluminum plate at the bottom of a tub. In some embodiments, each of the tubs is mounted on an aluminum plate, also referred to herein as a valve plate. In some embodiments, each of the tubs is mounted on a heat sink.

The two backlights 26*a* and 26*b* receive signals from the chaos circuit 24, which cause the backlights 26*a* and 26*b* to flicker and provide the naturalistic flame lighting. The backlights 26*a* and 26*b* are situated in the housing 28 toward the back wall 40 and the two side walls 36 and 38. The flickering light of the backlights 26*a* and 26*b* reflects off at least the back wall 40 and the two side walls 36 and 38 to provide a naturalistic looking flicker at the edges of the log and ember arrangement 30. In some embodiments, the two backlights 26*a* and 26*b* are synchronized to provide the naturalistic flame lighting.

The three ember lights 26*c*, 26*d*, and 26*e* receive signals from the chaos circuit 24, which cause the ember lights 26*c*, 26*d*, and 26*e* to irregularly glow and provide the naturalistic ember lighting. The ember lights 26*c*, 26*d*, and 26*e* are situated toward the front of the housing 28 and behind the artificial embers 44. The activated ember lights 26*c*, 26*d*, and 26*e* glow through the translucent portions of the artificial embers 44 to provide a naturalistic looking glow to the artificial embers 44 of the log and ember arrangement 30. In some embodiments, the three ember lights 26*c*, 26*d*, and 26*e* are activated independently of one another to provide the naturalistic ember lighting.

Figure 2:
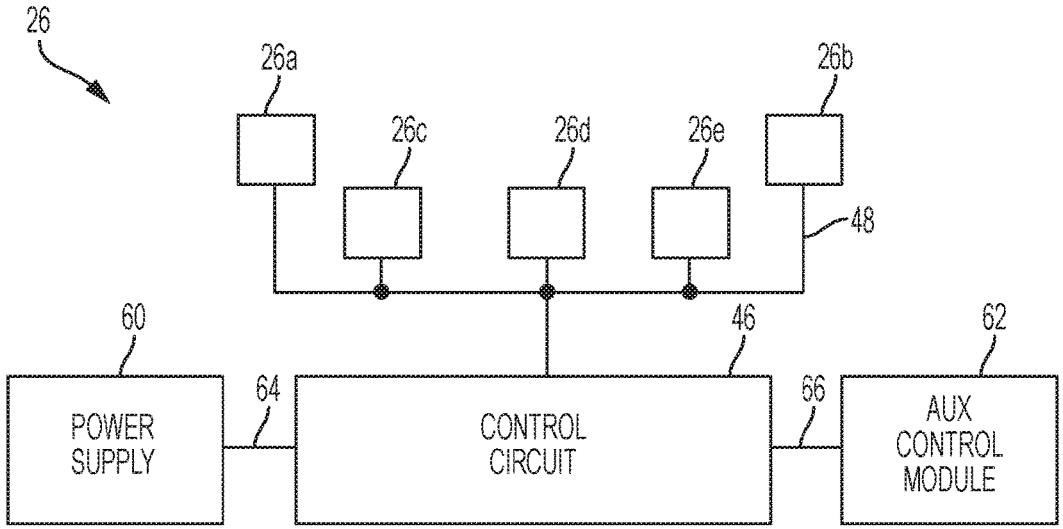
FIG. 2 is a diagram illustrating the control circuit, the plurality of lights, a power supply, and an auxiliary control module, according to embodiments of the disclosure.

FIG. 2 is a diagram illustrating the control circuit 46, the plurality of lights 26, a power supply 60, and an auxiliary control module 62, according to embodiments of the disclosure. The control circuit 46 is electrically coupled to the plurality of lights 26 via conductive path 48, to the power supply 60 via conductive path 64, and to the auxiliary control module 62 via conductive path 66. In some embodiments, conductive path 48 is an electrical bus coupled to the plurality of lights 26. In some embodiments, conductive path 66 is a communications path, such as a wired or wireless communications path, between the control circuit 46 and the auxiliary control module 62.

The power supply 60 provides power to the control circuit 46 and through the control circuit 46 to the plurality of lights 26. In some embodiments, the power supply 60 provides 12 volt DC (direct current) power to the control circuit 46. In some embodiments, the control circuit 46 provides power, such as 12 volt DC power, to each of the plurality of lights 26 via two power lines for each of the plurality of lights 26.

The power supply 60 receives power from a mains circuit, such as a 120 volt or 240 volt mains circuit. The mains circuit can be at United States power and frequency levels or at International power and frequency levels. In some embodiments, the power supply 60 provides power to the auxiliary control circuit 62. In some embodiments, the power supply 60 provides power to other electrical components of the fireplace 20.

Lighting of the log and ember arrangement 30 is turned on or activated automatically when the fireplace 20 is turned on or activated to provide heat, such as when a gas flame or an ethanol flame is lit and burning. In some embodiments, the control circuit 46 is electrically coupled to a sensor (not shown) that senses the fireplace 20 is turned on or activated to provide heat and the control circuit 46 responds to signals from the sensor to turn on or activate the lighting of the log and ember arrangement 30. In some embodiments, the control circuit 46 is communicatively coupled to the auxiliary control circuit 62 to receive signals that indicate whether or not the fireplace 20 is turned on or activated to provide heat and the control circuit 46 responds to these signals from the auxiliary control circuit 62 to turn on or activate the lighting of the log and ember arrangement 30.

The auxiliary control module 62 provides control from the end user to the control circuit 46 and other components of the fireplace 20. In some embodiments, the auxiliary control module 62 provides control for activating/deactivating the fireplace 20 to provide heat. In some embodiments, the auxiliary control module 62 provides manual control for activating/deactivating the fireplace 20 to provide heat. In some embodiments, the auxiliary control module 62 provides remote control for activating/deactivating the fireplace 20 to provide heat.

In some embodiments, the auxiliary control module 62 provides control for activating/deactivating the backlight flicker light, the ember glow lighting, or both. In some embodiments, the auxiliary control module 62 provides manual control for activating/deactivating the backlight flicker light, the ember glow lighting, or both. In some embodiments, the auxiliary control module 62 provides remote control for activating/deactivating the backlight flicker light, the ember glow lighting, or both.

Figure 3:
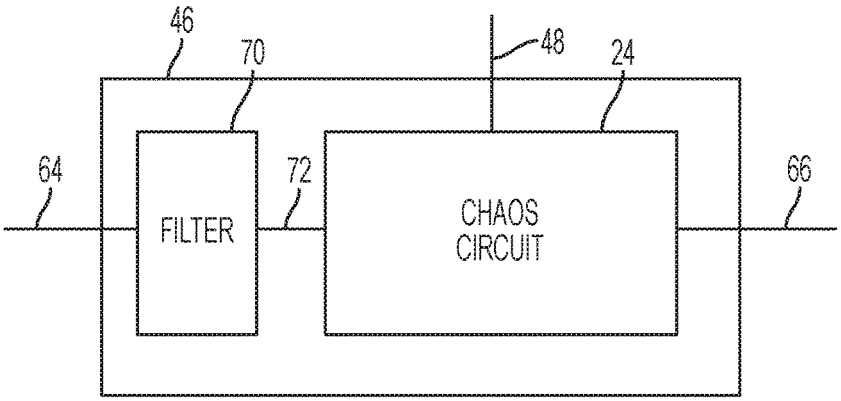
FIG. 3 is a diagram illustrating the control circuit, according to embodiments of the disclosure.

FIG. 3 is a diagram illustrating the control circuit 46, according to embodiments of the disclosure. The control circuit 46 includes a power supply filter 70 and the chaos circuit 24. The power supply filter 70 is electrically coupled to the power supply 60 via conductive path 64 and to the chaos circuit 24 via conductive path 72. The chaos circuit 24 is electrically coupled to the plurality of lights 26 via conductive path 48 and to the auxiliary control module 62 via conductive path 66.

The power supply filter 70 receives power from the power supply 60 and filters the power to provide a smoother, filtered output to the chaos circuit 24. The chaos circuit 24 receives the power from the power supply filter 70 and is activated to provide signals to the plurality of lights 26 to provide the naturalistic flame and ember lighting.

The chaos circuit 24 is based on or operates on chaos theory, which is a branch of mathematics focused on the behavior of dynamical systems that are highly sensitive to initial conditions. In chaos theory, sometimes referred to as deterministic chaos theory, a small change in one state of a deterministic nonlinear system can result in a large difference in a later state. This results in later states being very different from one another, even when initial conditions appear to be the same or are close to the same. In electronics, Chua's circuit is a simple electronic circuit that exhibits classic chaos theory behavior, which means roughly that it is a non-periodic oscillator that produces an oscillating waveform that, unlike an ordinary oscillator, never repeats. It was invented in 1982 by Leon Chua.

Chaos theory is related to random number generation, but different from random number generation theory. If signals from a random number generator alone were used to illuminate the plurality of lights 26, the end user would be able to recognize patterns and the pseudo-randomness of the signals. However, when signals from the chaos circuit 24 are applied to the plurality of lights 26, the end user has a much more difficult time or cannot distinguish patterns in the lighting, which leads to a much more realistic looking flame and a much more realistic looking ember glow effect. Thus, incorporation of chaos theory in the chaos circuit 24 leads to signals from the chaos circuit 24 being different each time the chaos circuit 24 is powered up and not appearing to be random, which leads to a much more realistic looking flame and a much more realistic looking ember glow effect.

Figure 4:
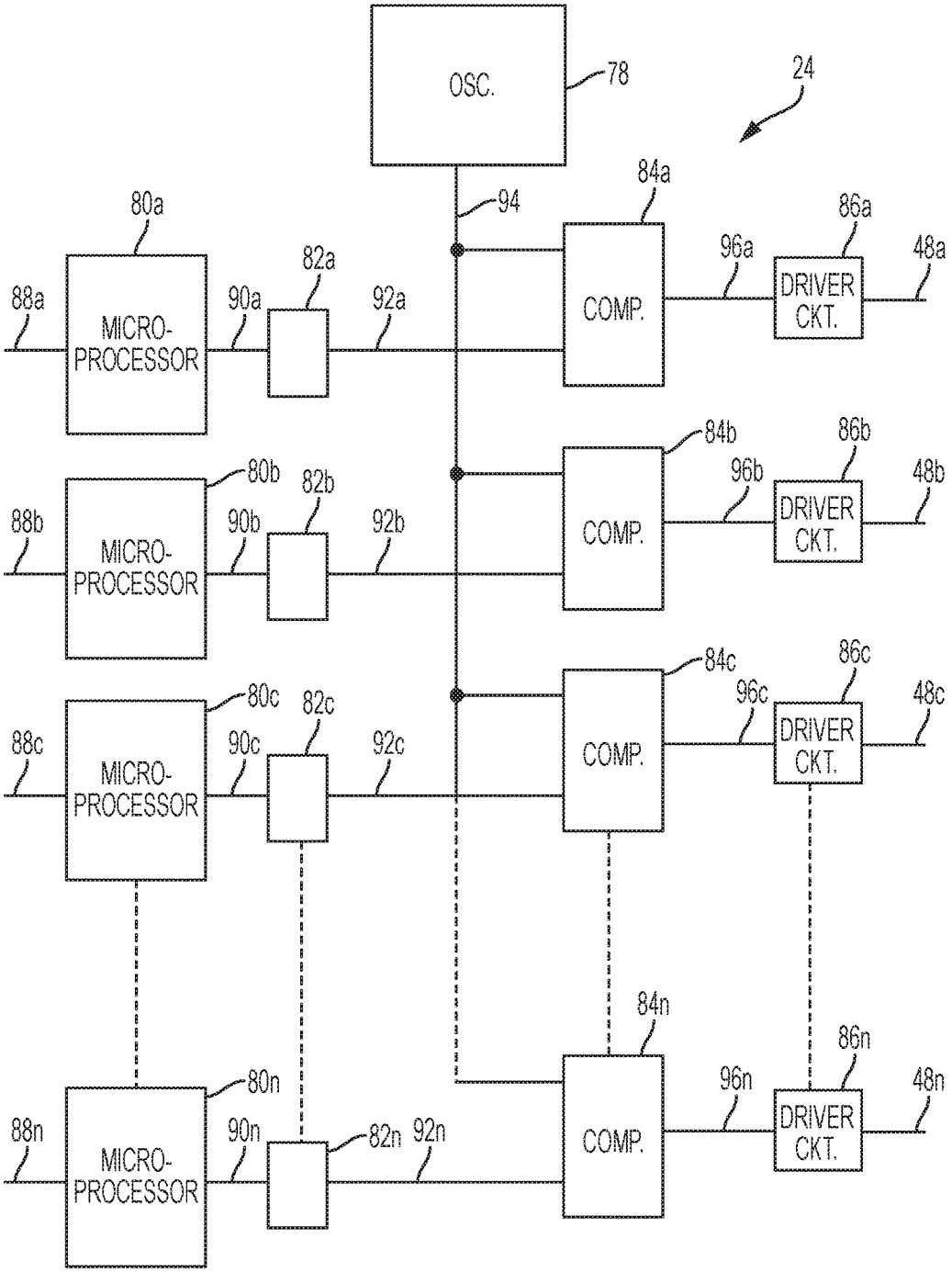
FIG. 4 is a block diagram illustrating the chaos circuit, according to embodiments of the disclosure.

FIG. 4 is a block diagram illustrating the chaos circuit 24, according to embodiments of the disclosure. The chaos circuit 24 generates random numbers that are used to provide random number outputs that are filtered and compared to a pseudo-chaotic event. The comparison results are used to light the plurality of lights 26.

The chaos circuit 24 includes an oscillator 78, a plurality of microprocessors 80*a*-80*n*, a plurality of filters 82*a*-82*n*, a plurality of comparators 84*a*-84*n*, and a plurality of output driver circuits 86*a*-86*n*. Each of the plurality of microprocessors 80*a*-80*n* is electrically coupled to one of the input paths 88*a*-88*n* (88 in FIG. 6), respectively, to receive data, clock, clear, and/or other control signals. Also, each of the plurality of microprocessors 80*a*-80*n* is electrically coupled to one of the plurality of filters 82*a*-82*n*, respectively, via pulse width modulated (PWM) output paths 90*a*-90*n* (90 in FIG. 6), respectively. Further, each of the plurality of filters 82*a*-82*n* is electrically coupled to an input of one of the plurality of comparators 84*a*-84*n*, respectively, via filtered output paths 92*a*-92*n*, respectively. Also, another input of each of the plurality of comparators 84*a*-84*n* is electrically coupled to the output of oscillator 78 via oscillator output path 94. The output of each of the plurality of comparators 84*a*-84*n* is electrically coupled to one of the plurality of output circuits 86*a*-86*n*, respectively, via comparator output paths 96*a*-96*n*, respectively, and each of the plurality of output circuits 86*a*-86*n* provides a chaos signal to one of the plurality of lights 26 via one of the output paths 48*a*-48*n*, respectively.

In some embodiments, the chaos circuit 24 includes oscillator 78, four microprocessors 80*a*-80*c* and 80*n*, four filters 82*a*-82*c* and 82*n*, four comparators 84*a*-84*c* and 84*n*, and four output driver circuits 86*a*-86*c* and 86*n*, electrically coupled as described above. Each of the four output driver circuits 86*a*-86*c* and 86*n* provides a chaos output signal for driving one of the plurality of lights 26. In some embodiments, output driver circuit 86*a* provides an output signal to ember light 26*c*, output driver circuit 86*b* provides an output signal to ember light 26*d*, and output driver circuit 86*c* provides an output signal to ember light 26*e*. These output signals to the ember lights 26*c*-26*e* are generated independently of each other. In some embodiments, output driver circuit 86*n* provides an output signal to backlights 26*a* and 26*b*, such that the flicker backlights 26*a* and 26*b* are synchronized to provide naturalistic flame lighting.

Each of the plurality of microprocessors 80*a*-80*n* includes a software program stored in memory that is executed to continuously generate polynomial results. The least significant bits of the polynomial results are outputted from the microprocessor to produce, what is referred to herein as, a pulse width modulated (PWM) signal. The PWM signal is a binary signal that is a non-return-to-zero series of 1's and 0's. The polynomial numbers generated will always be different, which provides random number generation. These random numbers are then converted to the PWM signal on the output of the microprocessor. In some embodiments, each of the plurality of microprocessors 80*a*-80*n* generates random numbers based on the rate of power applied to the microprocessor. In some embodiments, a difference in the rate of power applied to each of the plurality of microprocessors 80*a*-80*n* influences random number generation or the random numbers generated by another one of the plurality of microprocessors 80*a*-80*n*. In some embodiments, each of the microprocessors is a PIC, such as PIC12F675.

Each of the PWM signals is provided to an analog circuit portion of the chaos circuit 24 to generate the chaos signals. Each of the PWM signals is provided to one of the filters 82*a*-82*n*, which receives the PWM signal and provides an analog filtered output signal. In some embodiments, the PWM signal switches between 0 and 5 volts and the resulting filtered output signal is between 1 and 3 volts.

The oscillator 78 is a bi-stable oscillator that oscillates to provide pseudo-chaotic oscillator output signals on oscillator output path 94. In some embodiments, the oscillator 78 provides signals between 1 or 1.5 volts and 4.5 volts.

Each of the comparators 84*a*-84*n* receives one of the filtered output signals and the oscillator output signal and provides a comparator output signal based on the comparison of the received signals. The comparator output signal is provided to one of the output driver circuits 86*a*-86*n* to provide the chaos signal to one of the plurality of lights 26. In some embodiments, the chaos circuit 24 automatically generates the chaos signals in response to power being applied to the chaos circuit 24.

Figure 5:
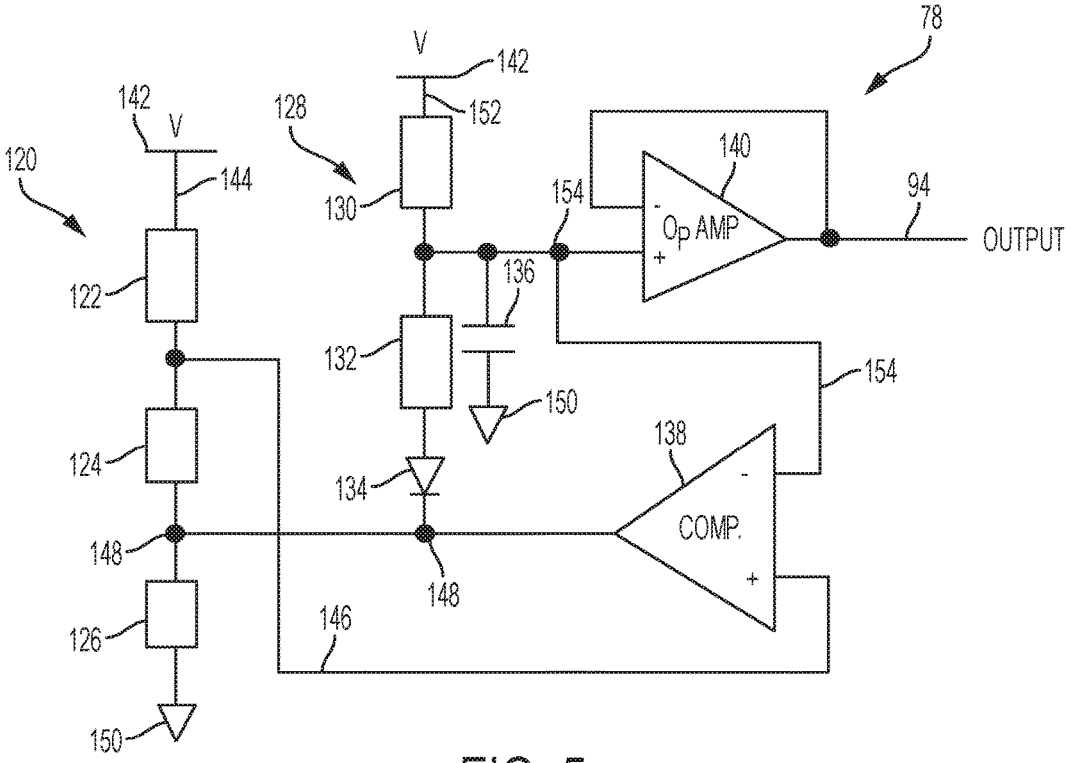
FIG. 5 is a diagram illustrating the oscillator, according to embodiments of the disclosure.

FIG. 5 is a diagram illustrating the oscillator 78, according to embodiments of the disclosure. The oscillator 78 includes a resistor divide network 120 that includes a first resistor 122, a second resistor 124, and a third resistor 126; a resistor/diode network 128 that includes a fourth resistor 130, a fifth resistor 132, and a diode 134; a capacitor 136; a comparator 138; and an operational amplifier 140.

One side of the first resistor 122 is electrically coupled to power V 142 via conductive path 144 and the other side of the first resistor 122 is electrically coupled to one side of the second resistor 124 and the positive input of comparator 138 via conductive path 146. The other side of the second resistor 124 is electrically coupled to one side of the third resistor 126 and the output of the comparator 138 via conductive path 148. The other side of the third resistor 126 is electrically coupled to a common 150, such as ground. In some embodiments, the first resistor 122 is a 200 kilo-ohm resistor. In some embodiments, the second resistor 124 is a 33 kilo-ohm resistor. In some embodiments, the third resistor 126 is a 2 mega-ohm resistor.

Also, one side of the fourth resistor 130 is electrically coupled to power V 142 via conductive path 152 and the other side of the fourth resistor 130 is electrically coupled to one side of the fifth resistor 132 and to the positive input of operational amplifier 140 via conductive path 154. The other side of the fifth resistor 132 is electrically coupled to one side of the diode 134 and the other side of the diode 134 is electrically coupled to the output of the comparator via conductive path 148. One side of the capacitor 136 is electrically coupled to the positive input of operational amplifier 140 via conductive path 154 and the other side of the capacitor 136 is electrically coupled to the common 150. In some embodiments, the fourth resistor 130 is a 33 kilo-ohm resistor. In some embodiments, the fifth resistor 132 is a 1 kilo-ohm resistor. In some embodiments, the capacitor 136 is a 0.1 micro-farad capacitor.

Further, the negative input of the comparator 138 is electrically coupled to the positive input of operational amplifier 140 via conductive path 154, and the negative input of the operational amplifier 140 is electrically coupled to the output of the operational amplifier 140 via oscillator output path 94. The oscillator 78 is electrically coupled to each of the plurality of comparators 84*a*-84*n* via oscillator output path 94. In some embodiments, the comparator 138 is part of an LM393. In some embodiments, the operational amplifier 140 is part of an MCP607.

In operation, power is applied to the chaos circuit 24 and the oscillator 78 begins oscillating. The oscillator 78 is a bi-stable oscillator that oscillates to provide pseudo-chaotic oscillator output signals on oscillator output path 94. The oscillator 78 provides an output signal that oscillates between 1 volt or 1.5 volts and 4.5 volts.

Figure 6:
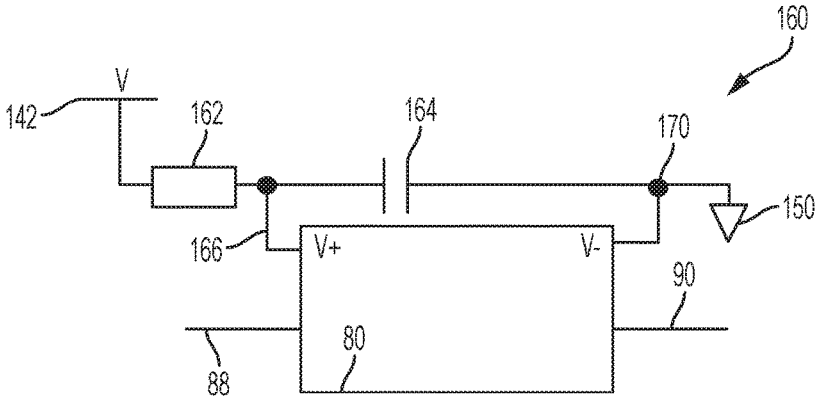
FIG. 6 is a diagram illustrating a microprocessor circuit, according to embodiments of the disclosure.

FIG. 6 is a diagram illustrating a microprocessor circuit 160, according to embodiments of the disclosure. The microprocessor circuit 160 includes a resistor 162, a capacitor 164, and one of the plurality of microprocessors 80*a*-80*n* (80 in FIG. 6). One side of the resistor 162 is electrically coupled to power V 142 and the other side of the resistor 162 is electrically coupled to the V+ power input of the microprocessor and to one side of capacitor 164 via conductive path 166. The other side of the capacitor 164 is electrically coupled to the V− power input of the microprocessor and to a common 150, such as ground, via conductive path 170.

The value of resistor 162 can be or is different for different microprocessors of the plurality of microprocessors 80*a*-80*n*. The different resistor values provide different power or current to the different microprocessors of the plurality of microprocessors 80*a*-80*n*. This causes the different microprocessors of the plurality of microprocessors 80*a*-80*n* to boot a little faster or slower and differentiates the random number sequences coming out of the microprocessor more quickly. If the resistor values are all the same, differentiation may take 2-4 minutes or more, but with different resistor values differentiation occurs within a matter of 1-2 seconds. This differentiates the random numbers at the outputs of the different microprocessors and the chaos signals provided to the ember lights 26*c*-26*e* and the backlights 26*a* and 26*b*.

In some embodiments, the value of resistor 162 with microprocessor 80*a* is 1 kilo-ohm. In some embodiments, the value of resistor 162 with microprocessor 80*b* is 1.5 kilo-ohm. In some embodiments, the value of resistor 162 with microprocessor 80*c* is 2 kilo-ohm. In some embodiments, the value of resistor 162 with microprocessor 80*n* is 1 kilo-ohm. In some embodiments, the value of capacitor 164 is 4.7 micro-farads.

Figure 7:
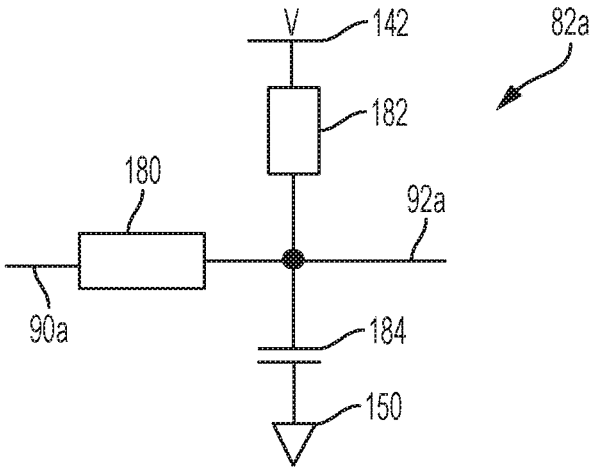
FIG. 7 is a diagram illustrating a filter of the plurality of filters, according to embodiments of the disclosure.

FIG. 7 is a diagram illustrating filter 82*a* of the plurality of filters 82*a*-82*n*, according to embodiments of the disclosure. In some embodiments, one or more of the other filters 82*b*-82*n* of the plurality of filters 82*a*-82*n* are similar to the filter 82*a*.

The filter 82*a* includes a first resister 180, a second resistor 182, and a capacitor 184. One side of the first resistor 180 is electrically coupled to microprocessor 80*a* via PWM output path 90*a* and the other side of the first resistor 180 is electrically coupled to an input of comparator 84*a* via filtered output path 92*a*. Also, one side of the second resistor 182 is electrically coupled to power V 142 and the other side of the second resistor 182 is electrically coupled to the other side of the first resistor 180 and one side of the capacitor 184 via filtered output path 92*a*. The other side of the capacitor 184 is electrically coupled to common 150, such as ground.

In some embodiments, the value of first resistor 180 is 180 kilo-ohms. In some embodiments, the value of second resistor 182 is 2 mega-ohms. In some embodiments, the value of capacitor 184 is 3.3 micro-farads.

The filter 82*a* receives a PWM output signal from microprocessor 80*a* via PWM output path 90*a*. The PWM output signal is based on random numbers generated by the microprocessor 80*a*. The filter 82*a* filters the PWM output signal through the RC filter and provides an analog filtered output signal to the input of comparator 84*a* via filtered output path 92*a*. The comparator 84*a* receives the filtered output signal from filter 82*a* and the oscillator output signal from oscillator 78 and provides a comparator output signal to output circuit 86*a* via comparator output path 96*a*. The output circuit 86*a* provides a chaos signal to one or more of the plurality of lights 26 via output path 48*a*. In some embodiments, each of the plurality of filters 82*a*-82*n* is the same as filter 82*a*.

Figure 8:
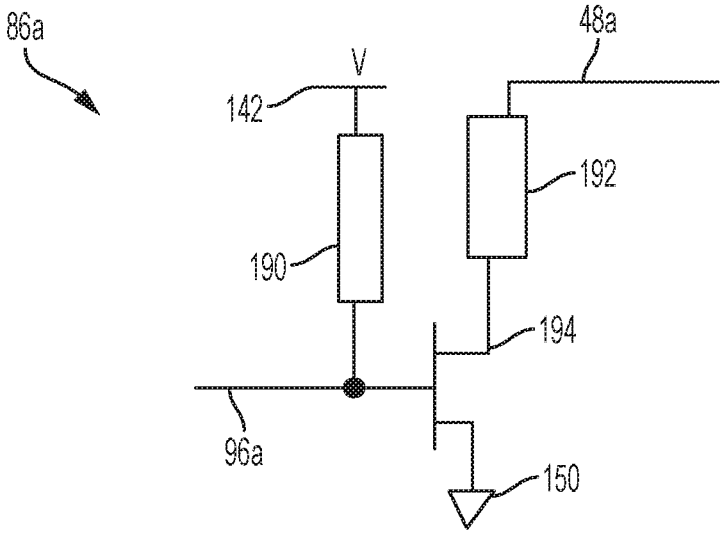
FIG. 8 is a diagram illustrating output circuit, according to embodiments of the disclosure.

FIG. 8 is a diagram illustrating output circuit 86*a*, according to embodiments of the disclosure. In some embodiments, one or more of the other output circuits 86*b*-86*n* of the plurality of output circuits 86*a*-86*n* are similar to the output circuit 86*a*.

The output circuit 86*a* includes a first resister 190, a second resistor 192, and an NMOS transistor 194. One side of the first resistor 190 is electrically coupled to power V 142 and the other side of the first resistor 190 is electrically coupled to the output of comparator 84*a* and the input of NMOS transistor 194 via comparator output path 96*a*. One side of the second resistor 192 is electrically coupled to one of the plurality of lights 26 via output path 48*a* and the other side of the second resistor 192 to one side of the drain-source path of the NMOS transistor 194. The other side drain-source path is electrically coupled to common 150, such as ground.

In some embodiments, the value of first resistor 190 is 10 kilo-ohms. In some embodiments, the value of second resistor 192 is 20 ohms.

The output circuit 86*a* receives the comparator output signal from comparator 84*a* via comparator output path 96*a*. The output circuit 86*a* provides a chaos signal to one or more of the plurality of lights 26 via output path 48*a*. In some embodiments, each of the plurality of output circuits 86*a*-86*n* is the same as output circuit 86*a*.

Figure 9:
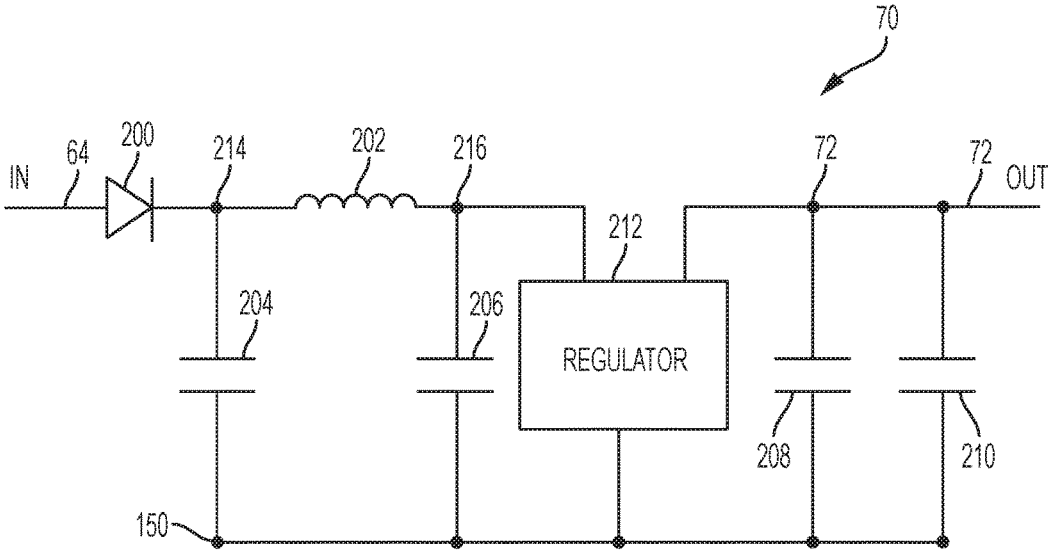
FIG. 9 is a diagram illustrating a power supply filter, according to embodiments of the disclosure.

FIG. 9 is a diagram illustrating a power supply filter 70, according to embodiments of the disclosure. The power supply filter 70 includes a diode 200, an inductor 202, a first capacitor 204, a second capacitor 206, a third capacitor 208, a fourth capacitor 210, and a regulator 212. One side of the diode 200 is electrically coupled to the power supply 60 via conductive path 64 and the other side of the diode 200 is electrically coupled to one side of the inductor 202 and to one side of the first capacitor 204 via conductive path 214.

The other side of the first capacitor 204 is electrically coupled to common 150, such as ground.

The other side of the inductor 202 is electrically coupled to one side of the second capacitor 206 and to the input of the regulator 212 via conductive path 216. Also, the other side of the second capacitor 206 and the regulator 212 are electrically coupled to common 150.

The output of the regulator 212 is electrically coupled to one side of the third capacitor 208 and to one side of the fourth capacitor 210 via conductive path 72, which is electrically coupled to the chaos circuit 24. The other side of the third capacitor 208 and the other side of the fourth capacitor 210 are electrically coupled to common 150.

In some embodiments, inductor 202 has a value of 12 micro-henrys. In some embodiments, first capacitor 204 has a value of 1000 micro-farads. In some embodiments, second capacitor 206 has a value of 0.1 micro-farads. In some embodiments, third capacitor 208 has a value of 0.1 micro-farads. In some embodiments, fourth capacitor 210 has a value of 470 micro-farads.

The power supply filter 70 receives power from the power supply 60 and filters the power through the LC circuit to the input of the regulator 212. The output of the regulator 212 provides a regulated output voltage to the third and fourth capacitors 208 and 210 and to the chaos circuit 24. The chaos circuit 24 receives the power from the power supply filter 70 and is activated to provide signals to the plurality of lights 26 to provide the naturalistic flame and ember lighting.

Figure 10:
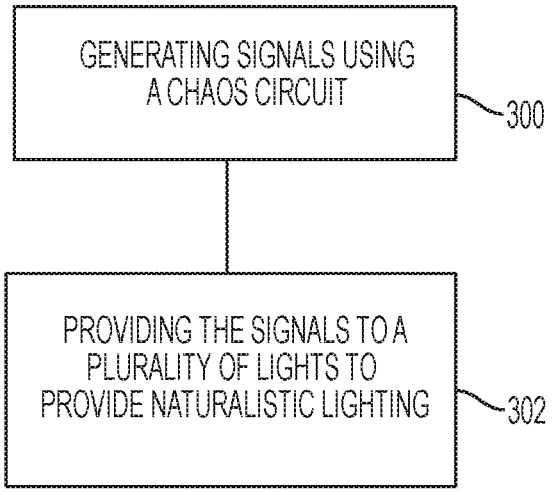
FIG. 10 is a method of providing light in a fireplace, according to embodiments of the disclosure.

FIG. 10 is a method of providing light in a fireplace, according to embodiments of the disclosure. At 300, the method includes generating signals, such as chaos signals, using a chaos circuit. In some embodiments, generating signals includes generating at least one backlight signal using the chaos circuit. In some embodiments, generating signals includes generating at least one ember light signal using the chaos circuit.

At 302, the method includes providing the signals to a plurality of lights to provide naturalistic lighting. In some embodiments, providing the signals includes providing at least one backlight signal to at least one backlight, such that the at least one backlight flickers in response to the at least one backlight signal to provide naturalistic flame lighting. In some embodiments, providing the signals includes providing at least one ember light signal to at least one ember light, such that the at least one ember light irregularly glows in response to the at least one ember light signal to provide naturalistic ember lighting.

In some embodiments, generating signals includes generating random numbers via at least one microprocessor, providing filtered results based on the random numbers, receiving the filtered results at an analog circuit, such as a comparator, and providing chaos signals from the analog circuit. In some embodiments, generating signals includes generating an oscillator output signal via an oscillator and comparing the oscillator output signal and the filtered results via at least one comparator to provide the chaos signals from the analog circuit. In some embodiments, generating signals includes generating random numbers via at least one microprocessor, such that the random numbers are generated based on the rate of power applied to each of the at least one microprocessor.

Various modifications and additions can be made to the embodiments discussed without departing from the scope of the present disclosure. Moreover, while the embodiments described above refer to particular features, the scope of this disclosure also includes embodiments having different combinations of features and embodiments that do not include all of the above described features.

What is claimed is:

1. A light system for a fireplace, comprising:

a plurality of lights; and a chaos circuit coupled to the plurality of lights and configured to provide signals to the plurality of lights to provide naturalistic flame lighting and naturalistic ember lighting, wherein the plurality of lights includes at least two backlights that receive at least one of the signals and the at least two backlights flicker based on the at least one of the signals to provide the naturalistic flame lighting, wherein the at least two backlights are synchronized to provide the naturalistic flame lighting.

2. The light system of claim 1, wherein the at least two backlights are situated to reflect off one or more walls of the fireplace.

3. The light system of claim 1, wherein the plurality of lights includes at least one ember light that receives one or more of the signals and the at least one ember light irregularly glows based on the one or more of the signals to provide the naturalistic ember lighting.

4. The light system of claim 3, wherein the at least one ember light is situated behind artificial embers in the fireplace to illuminate the artificial embers.

5. The light system of claim 1, wherein the plurality of lights includes at least three ember lights that receive one or more of the signals and the at least three ember lights irregularly glow based on the one or more of the signals to provide the naturalistic ember lighting.

6. The light system of claim 1, wherein the chaos circuit includes:

at least one microprocessor that generates random numbers;

at least one filter that provides filtered results based on the random numbers; and analog circuitry that receives the filtered results and provides the signals to drive the plurality of lights.

7. The light system of claim 3, wherein the analog circuitry includes:

an oscillator that generates an oscillator output signal; and at least one comparator that receives the oscillator output signal and the filtered results to provide the signals.

8. The light system of claim 1, wherein the chaos circuit includes a plurality of microprocessors that generate random numbers based on the rate of power applied to each of the plurality of microprocessors.

9. The light system of claim 1, wherein the chaos circuit includes a plurality of microprocessors and a difference in the rate of power applied to each of the microprocessors influences random number generation by another one of the plurality of microprocessors.

10. The light system of claim 1, wherein the chaos circuit includes:

a plurality of microprocessors configured to generate random numbers;

an oscillator configured to provide an oscillator output signal; and a plurality of analog comparators configured to receive the oscillator output signal and to receive filtered results based on the random numbers, wherein each of the plurality of microprocessors is coupled to a corresponding one of the plurality of analog comparators.

11. The light system of claim 1, wherein the chaos circuit automatically generates the signals in response to power being applied to the chaos circuit.

12. A light system for a fireplace, comprising:
lights; and
a chaos circuit coupled to the lights, the chaos circuit configured to provide drive signals that illuminate the lights to provide naturalistic lighting, the chaos circuit comprising:
a plurality of microprocessors configured to generate random numbers; and
an analog circuit that receives filtered signals based on the random numbers and provides the drive signals based on the filtered signals.

13. The light system of claim 12, wherein the chaos circuit comprises:
an oscillator configured to provide an oscillator output signal; and
a plurality of analog comparators configured to receive the oscillator output signal and to receive the filtered results.

14. The light system of claim 13, wherein each of the plurality of microprocessors is coupled to a corresponding one of the plurality of analog comparators.

15. The light system of claim 12, wherein the lights include at least one backlight and the analog circuit provides at least one backlight signal to illuminate the at least one backlight to provide naturalistic flame lighting.

16. The light system of claim 12, wherein the lights include at least one ember light and the analog circuit provides at least one ember light signal to illuminate the at least one ember light to provide naturalistic ember lighting.

17. The light system of claim 12, wherein each of the plurality of microprocessors includes a program that generates polynomial results, uses the polynomial results to generate the random numbers, and directs the microprocessor to output least significant bits of the random numbers to produce a pulse width modulated output signal that is filtered and provided to the analog circuit to generate the drive signals.

18. The light system of claim 12, wherein the chaos circuit automatically generates the drive signals in response to power being applied to the chaos circuit.

19. A method of providing light in a fireplace, the method comprising:
generating signals using a chaos circuit; and
providing the signals to a plurality of lights to provide naturalistic lighting,
wherein generating signals and providing the signals comprises:
generating random numbers via a plurality of microprocessors;
providing filtered results based on the random numbers;
generating an oscillator output signal via an oscillator; and
comparing the oscillator output signal and the filtered results at a plurality of analog comparators, wherein each of the plurality of analog comparators receives a corresponding one of the filtered results that is based on the random numbers from one of the plurality of microprocessors.

20. The method of claim 19, wherein generating signals and providing the signals comprises:
generating at least one backlight signal using the chaos circuit; and
providing the at least one backlight signal to at least one backlight, such that the at least one backlight flickers in response to the at least one backlight signal to provide naturalistic flame lighting.

21. The method of claim 19, wherein generating signals and providing the signals comprises:
generating at least one backlight signal using the chaos circuit; and
providing the at least one backlight signal to at least two backlights, such that the at least two backlights flicker in response to the at least one backlight signal and the at least two backlights are synchronized to provide naturalistic flame lighting.

22. The method of claim 19, wherein generating signals and providing the signals comprises:
generating at least one ember light signal using the chaos circuit; and
providing the at least one ember light signal to at least one ember light, such that the at least one ember light irregularly glows in response to the at least one ember light signal to provide naturalistic ember lighting.

23. The method of claim 19, wherein generating signals and providing the signals comprises:
generating at least one ember light signal using the chaos circuit; and
providing the at least one ember light signal to at least three ember lights, such that the at least three ember lights irregularly glow in response to the at least one ember light signal to provide naturalistic ember lighting.

24. The method of claim 19, wherein generating signals comprises:
generating random numbers via at least one microprocessor, such that the random numbers are generated based on the rate of power applied to each of the at least one microprocessor.

25. The method of claim 19, comprising:
automatically generating the signals in response to power being applied to the chaos circuit.

26. A light system for a fireplace, comprising:
a plurality of lights; and
a chaos circuit coupled to the plurality of lights and configured to provide signals to the plurality of lights to provide naturalistic flame lighting and naturalistic ember lighting,
wherein the chaos circuit includes:
at least one microprocessor that generates random numbers;
at least one filter that provides filtered results based on the random numbers; and
analog circuitry that receives the filtered results and provides the signals to drive the plurality of lights.

27. The light system of claim 26, wherein the analog circuitry includes:
an oscillator that generates an oscillator output signal; and
at least one comparator that receives the oscillator output signal and the filtered results to provide the signals.

28. The light system of claim 26, wherein the plurality of lights includes at least one backlight that receives at least one of the signals and the at least one backlight flickers based on the at least one of the signals to provide the naturalistic flame lighting.

29. The light system of claim 28, wherein the at least one backlight is situated to reflect off one or more walls of the fireplace.

30. The light system of claim 26, wherein the plurality of lights includes at least two backlights that receive at least one of the signals and the at least two backlights flicker based on the at least one of the signals to provide the naturalistic flame lighting.

31. The light system of claim 30, wherein the at least two backlights are synchronized to provide the naturalistic flame lighting.

32. A light system for a fireplace, comprising:

a plurality of lights; and a chaos circuit coupled to the plurality of lights and configured to provide signals to the plurality of lights to provide naturalistic flame lighting and naturalistic ember lighting, wherein the chaos circuit includes a plurality of microprocessors that generate random numbers based on the rate of power applied to each of the plurality of microprocessors.

* * * * *